US006125564A

United States Patent [19]

Young

[11] Patent Number: 6,125,564

[45] Date of Patent: Oct. 3, 2000

[54] SHADOW BOX TYPE TRANSPARENCY DISPLAY DEVICE

[76] Inventor: Steven R. Young, 7667 Chalkstone Dr., Dallas, Tex. 75248

[21] Appl. No.: 09/041,564

[22] Filed: Mar. 12, 1998

[51] Int. Cl.[7] ..... G09F 13/12; G09F 19/00

[52] U.S. Cl. ..... 40/427; 40/219; 40/534

[58] Field of Search ..... 40/427, 900, 445, 40/219, 534; 746/82, 219, 489

[56] References Cited

U.S. PATENT DOCUMENTS 4,196,539 4/1980 Speers ..... 40/547

5,609,253 3/1997 Goade, Sr. ..... 206/460

*Primary Examiner*—Anthony Knight
*Assistant Examiner*—Vishal Patel
*Attorney, Agent, or Firm*—Jones, Day, Reavis & Pogue

[57] ABSTRACT

A shadow box type transparency display device that has a reflective surface and at least one transparency panel having a visual image thereon spaced from and in superimposed relationship with at least a portion of the reflective surface such that the visual image is visible in the reflective surface thereby creating a unique view that includes the visual image and the reflected visual image.

12 Claims, 3 Drawing Sheets

SHADOW BOX TYPE TRANSPARENCY DISPLAY DEVICE

BACKGROUND OF THE INVENTION

1. Field of the Invention

The present invention relates in general to display packages and more particularly to a shadow box type display device that has a reflective surface and at least one transparency panel having a first visual image thereon spaced from and in superimposed relationship with at least a portion of the reflective surface such that the visual image is visible in the reflective surface thereby creating a unique view that includes the visual image and the reflected visual image.

2. Description of Related Art Including Information Disclosed Under 37 CFR 1.97 and 1.98

As disclosed in commonly assigned copending patent application Ser. No. 08/986,444, filed Dec. 8, 1997, and entitled "Data Card Display Package and Method for Displaying a Data Card," there is disclosed an improved data card containing package for advertising the data card that has coded data disposed thereon. Such packages can be used to sell data cards such as prepaid calling cards for long distance telephone calls or other type cards that are popular with consumers. One type of card that is especially popular with a segment of the population is a trading card that could have a picture of a well-recognized sports figure or other celebrity and that has information on the card relating to that person. Such cards also relate to places or events such as the Grand Canyon, planets in space, and the like.

Further, commonly owned copending U.S. patent application Ser. No. 09/041,265 entitled "Transparency Display Apparatus", and filed of even date herewith, discloses a transparency display device in which one or more visual images or pictures can be visible in combination to a viewer. For instance, a transparency could have an athletic figure or prominent personality on a transparency held in a frame. A slidable panel can be placed under the transparency and moved from a first position under the transparency to a second position removed from under the transparency. The second position would allow the transparency to be visible to light through the package and present a first view of the visible image that is on the transparency. When the slide panel is moved to its first position under the transparency, it provides a backing for the transparency which may be a color backing or may have a visual image thereon to provide a different scene when associated with the first visual image. The sliding panel may have printed materials or indicia on the back thereof to describe or otherwise be related to the transparency visual image. As an example, the transparency could have a famous football player as the visual image and on the back side of the slidable panel may be statistics regarding the player. When the slidable panel is moved from its first position under the transparency to its second position removed from under the transparency, the transparency can then be either viewed when held up to light or with the use of a projector.

It would be desirable to have a shadow box type transparency display device with a reflective surface and a transparency having a first visual image thereon spaced from the reflective surface so that by looking through the transparency a viewer may see not only the first visual image but also its reflection in the shadow box.

SUMMARY OF THE INVENTION

The present invention relates to a shadow box type transparency display device in which there is at least a reflective surface and at least one transparency having a visual image thereon spaced from and in superimposed relationship with at least a portion of the reflective surface such that the visual image is visible on the reflective surface thereby creating a unique view that includes the visual image and the reflected visual image. The reflective surface may be placed at the bottom of an enclosed shadow box or may simply be spaced from the transparency panel such that by looking through the transparency panel the effect of a shadow box would be achieved.

In addition, a display rack may be provided that is formed of a material such as lightweight cardboard that can be folded at the four corners, thus creating a flat profile for shipping and that may be erected as a box with a rectangular shape. The top of opposing sidewalls may have spaced notches therein in which display panels may be placed to hold them in a spaced relationship for viewing. The slots may be tilted rearwardly at the top of the rack to cause the panel with the reflective surface and the transparency panels to be tipped to the rear for easy viewing.

In a second embodiment, a box or container is formed with a lid having a window therein covered by a transparency having a first visual image thereon. A ledge or other support means is provided on the interior of the top of the box for receiving a transparency card having a second visual image thereon. The bottom of the box may have a reflective surface therein such that when the box lid is closed, the viewer can see the top panel with the first visual image thereon, the superimposed removable transparency panel with the second visual image on it and the reflection of both the first and second visual images from the reflective surface at the bottom of the box to provide a unique view. In addition, the reflective surface itself may have a third unique visual image thereon that is in harmony with the other two visual images to provide a unique scene to a viewer. Removably attached to the bottom of the box is a second container having a shape that matches the circumference of the box and which can be removably attached thereto for containing additional transparency panels that can be removed and placed on the inside of the box when the lid is opened for viewing. The lid may be pivotally attached to the box.

In a final embodiment, the shadow box may have an open top portion spaced from a closed bottom portion. The closed bottom portion has an inside surface on which a reflective surface is placed. A transparency panel having a visual image thereon may be placed on, or be associated with, the open top portion of the shadow box such that the visual image of the transparency panel is visible in the reflective surface thereby creating a unique view that includes the visual image itself and the reflected visual image. If desired, of course, the reflective surface on the inside of the closed bottom portion of the shadow box may also have a visual image formed on it such that the viewer would see the first visual image on the transparency, the second visual image on the reflective surface and the reflection of the first visual image, thus creating a unique scene.

Thus it is an object of the present invention to provide a shadow box type transparency display device.

It is another object of the present invention to provide a shadow box type transparency display device having a reflective surface spaced from at least one transparency panel having a first visual image thereon to create a unique view that includes the first visual image and the reflection of the first visual image.

It is another object of the present invention to provide a shadow box type transparency display in which a reflective surface is spaced from a transparency panel having a first visual image thereon with a second visual image formed on the reflective surface to provide a unique viewing scene.

It is still another object of the present invention to provide a display rack in the form of a rectangular box having spaced slots extending inwardly from the top thereof on opposing side walls to hold in spaced relationship a card having a reflective surface thereon, and at least one transparency having a visual image thereon for providing a unique viewing scene.

It is still another object of the present invention to provide a first hollow rectangular container having side walls and a top and a bottom with a lid associated with the top of the container and having a window therein and including a reflective surface on the bottom of the container in spaced relationship to the lid with a transparency panel having with a first visual image covering the lid window to create a unique viewing scene. This embodiment also includes a second transparency placed under the lid inside of the container at the top thereof in spaced relationship with both the lid transparency and the bottom reflective surface to create a further unique viewing scene. The embodiment also has second hollow rectangular container having side walls and an open top and a closed bottom for holding a plurality of transparency panels that can be removably inserted inside the container under the lid and spaced from both the reflective surface and the transparency panel on the lid to create a unique view. The second hollow rectangular container holds a plurality of the removable transparency panels and the container is removably attached to the first container to form a unitary display device.

Thus the present invention relates to a shadow box type transparency display device comprising a reflective surface and at least one transparency panel having a first image thereon spaced from and in superimposed relationship with at least a portion of the reflective surface such that the visual image is visible in the reflective surface thereby creating a unique view that includes the visual image and the reflected visual image.

BRIEF DESCRIPTION OF THE DRAWINGS

These and other features of the present invention will be more fully disclosed when taken in conjunction with the following DETAILED DESCRIPTION OF THE PREFERRED EMBODIMENT(S) in which like numerals represent like elements and in which.

DETAILED DESCRIPTION OF THE PREFERRED EMBODIMENT(S)

The term "transparency", as used herein, means being capable of transmitting light so that objects or images can be seen as if there was no intervening material. The transparent material can be made of plastics such as mylar, acetate, or like material so long as it can transmit light therethrough. The visual images thereon can be created by photography, or printing, or otherwise placed thereon.

Figure 1:
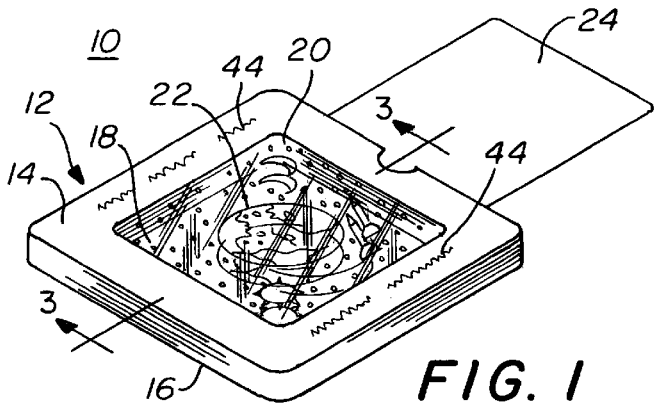
FIG. 1 is a perspective view of a first embodiment of the present invention illustrating a shadow box display device having a slidable panel removed outwardly from the display device.

FIGS. 1, 2, 3, and 4 disclose a first embodiment of the present invention. In this case, a shadow box type transparency display device 10 includes a shadow box 12 having an upper surface 14 and a lower surface 16. The shadow box is formed to have any desired predetermined depth between the top surface 14 and the bottom surface 16. On the inside of the bottom surface 16 is a reflective surface 18. In the first embodiment of the shadow box as shown in the cross-section in FIG. 3, a slidable panel 24 is placed under a transparency 20 that has a visual image at 22 including the earth, moon, sun, stars and a rocket. When the slidable panel 24 is moved outwardly as shown in FIG. 1, the visual image 22 on the transparency 20 is reflected in the mirrored surface 18 on the inside of the bottom panel 16 as shown. This creates a double image as illustrated in FIG. 1 which is fascinating, attractive, appealing, and provides a delightful appearance.

Thus the novel shadow box includes an open top portion 14 spaced from a closed bottom portion 16. The closed bottom portion 16 has an inside 36. See FIG. 2. A reflective surface 18 is placed on the inside 36 of the closed bottom portion 16. The transparency 20 has a visual image 22 thereon and is associated with the open top portion 14 and window 38 of the shadow box 12 such that the visual image 22 is visible in the reflective surface 18 thus creating a unique view that includes the visual image 22 and its reflection from surface 18. In the embodiment of the shadow box shown in FIG. 3, the panel 24 is slidably interposed between the transparency 20 and the closed bottom portion 16 for movement between a first position to enable viewing only of the transparency and the visual image 22 thereon with the movable panel 24 serving as a backing for the transparency 20 and a second position as shown in FIG. 1 to enable viewing of the transparency visual image 22 and its reflection from the reflective surface 18. This is clearly shown in cross-section in FIG. 3.

Figure 3:
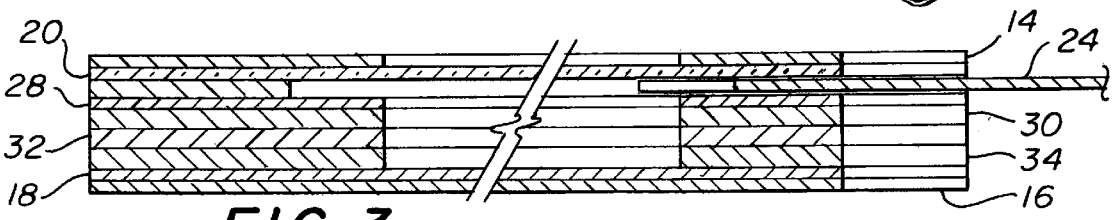
FIG. 3 is a partial cross-sectional view of the transparency display device of FIG. 1.
Figure 4:
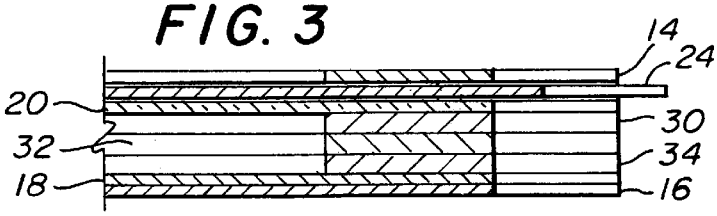
FIG. 4 is a partial cross-sectional view of a second embodiment of the novel shadow box transparency type display device of FIG. 1.

In a second embodiment as illustrated in FIG. 4, the slidable panel 24 is placed above the transparency 20 to serve as a dust cover to protect it. As can be seen in the exploded view in FIG. 2 and in the cross-sectional views of FIGS. 3 and 4, spacer frames 28, 30, 32, and 34 may be added in number as needed to determine the depth of the shadow box between the upper surface 14 and the lower surface 16. In FIG. 3, four such panels are illustrated while in FIG. 4, only three of the panels are used as spacers.

Figure 2:
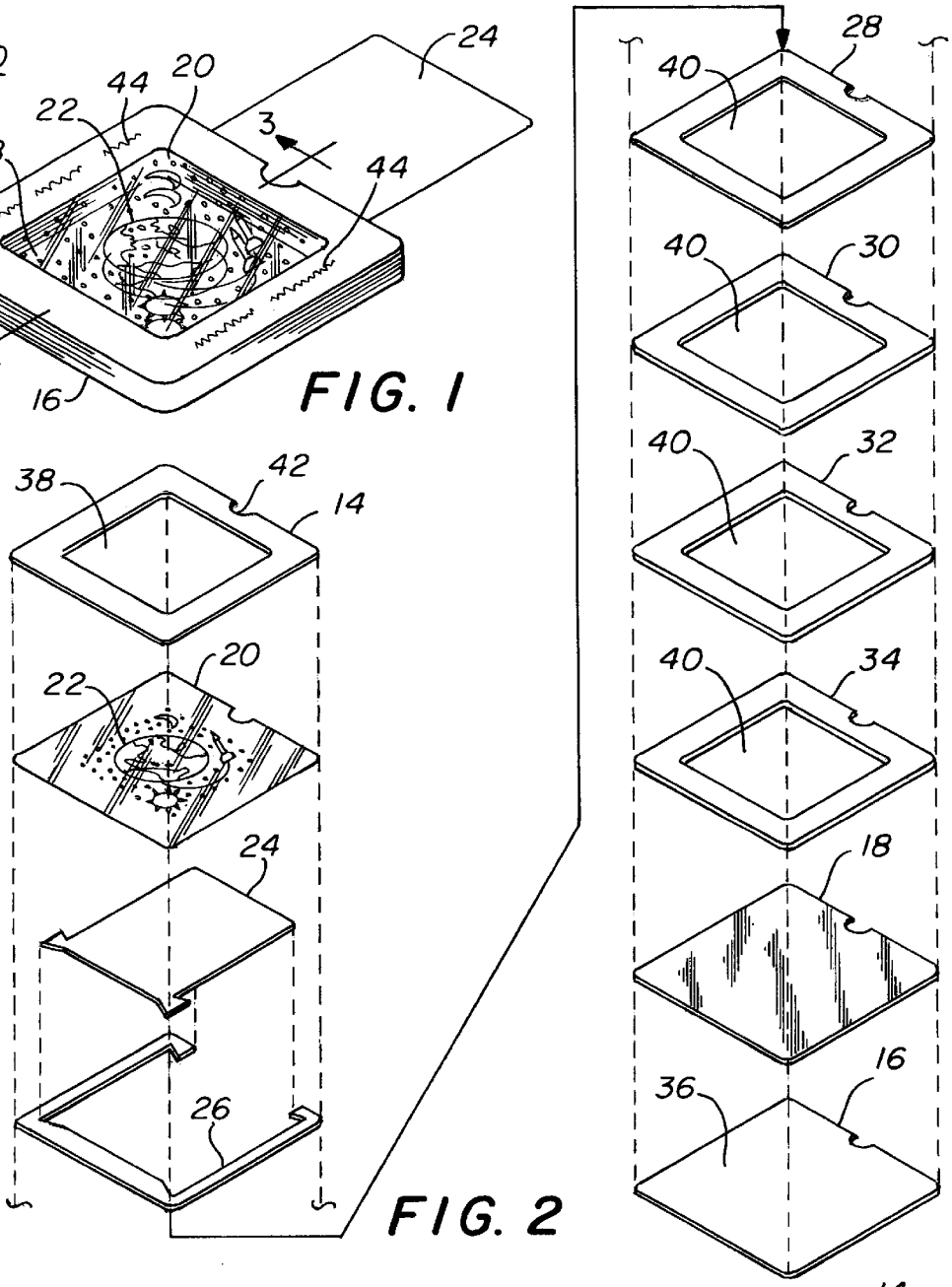
FIG. 2 is an exploded view of the novel shadow box display device of FIG. 1.

As can be clearly seen in FIG. 2, the sliding panel 24 moves in a frame 26 that enables the panel 24 to freely move inwardly and outwardly with respect to the shadow box 12. Further, it can be seen in FIG. 2 that each of the spacers 28, 30, 32, and 34 and the top wall 14 have a window 40 and 38, respectively, which are in superimposed aligned relationship. Where necessary, the various layers may have an indentation 42 therein to enable gripping of the panel 24 to move it inwardly and outwardly. Thus it can be seen in FIG. 1 that the shadow box type transparency display device 10 comprises a reflective surface 18 and at least one transparency 20 having a first visual image 22 thereon spaced from and in superimposed relationship with at least a portion of the reflective surface 18 such that the visual image 22 is visible in the reflective surface 18 thereby creating a unique view that includes the visual image 22 and its reflection.

The shadow box 12 also has an open top 14 spaced from a closed bottom portion 16. The closed bottom portion 16 has an inside surface 36. The reflective surface 18 is on the inside surface 36 of the closed bottom portion 16. The transparency panel 20 has the visual image 22 thereon associated with the open top portion 14 of the shadow box 12 such that the visual image 22 is visible in the reflective surface 18 thereby creating a unique view that includes the visual image 22 and the reflected visual image 22.

The transparency display device of FIGS. 1–3 further comprises a panel 24 slidably interposed between the transparency panel 20 and the closed bottom portion 16 for movement between a first position to enable viewing of the transparency panel 20 and the visual image 22 thereon with the movable panel 24 serving as a backing for the transparency panel 20 and a second position to enable viewing of the transparency visual image 22 and its reflection from the reflective surface 18.

In the embodiment shown in FIG. 4, the movable panel 24 has a first position for covering the transparency panel 20 and serving as a dust cover and a second position exposing the transparency panel 20 to enable viewing of the transparency visual image 22 and its reflection from the reflective surface 18. The transparency display device 10 may include information 44 on at least a portion of the display device 12 that relates to the visual image 22.

Figure 8A:
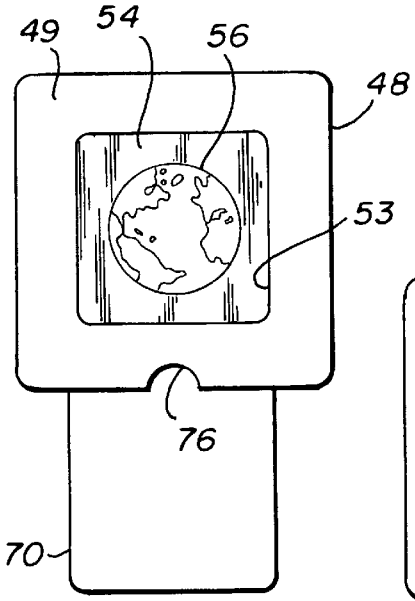
FIG. 8*a* is a front view of a reflective surface card having a panel that moves from the first position that may cover the reflective surface and a second position that reveals the reflective surface and that can be used as a support when placed in the display rack of FIG. 5.

As illustrated in FIG. 8*a*, the reflective surface 18 shown in FIG. 2 may have a second visual image 56 thereon as shown thereby creating a unique view that includes the first and second visual images 22 and 56 and the reflected first visual image 22. The second visual image 56 may be printed on the reflective surface 18 placed on the reflective surface 18 with photography in a well know manner.

Figure 5:
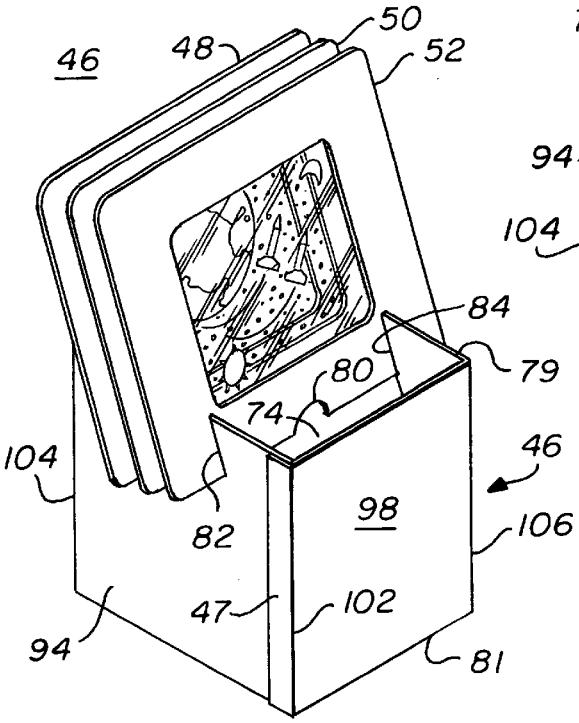
FIG. 5 is an isometric view of a second embodiment of the shadow box type display device that is created with a display rack, a card having a reflective surface thereon and at least one transparency panel having a first visual image thereon.

FIGS. 5, 6, 7, 8*a*, 8*b* and 8*c* all relate to a second embodiment of the present invention. This embodiment, as can be seen in FIG. 5, includes a display rack 46 has opposing slots in opposing side walls 94 and 96 to hold a plurality of transparency panels (see FIGS. 8*b*, and 8*c*) in spaced part superimposed relationship with a reflective surface 54 on a panel or card 48 as can be seen in FIG. 8*a*.

Figure 7:
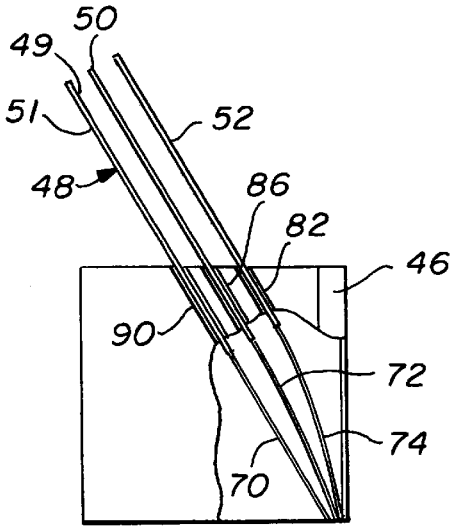
FIG. 7 is a side view partially cut away to show the display device of FIG. 5.

As can be seen in FIG. 8*a*, the panel or card 48 that holds the mirrored or reflective surface 54 has a front frame 49 and a back frame 51 (as can be seen in FIG. 7) with a window 53 therein on which a second visual image 56 is formed in any well known manner such as by photography or printing. The extendable panel 70 may be moved from a first position covering the reflective surface 54 and its visual image 56 to a second extended position as shown exposing the mirrored reflective surface 54 and its visual image 56.

Figure 8B:
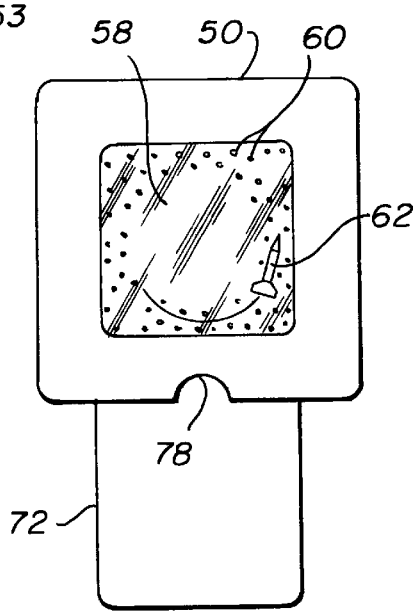
FIGS. 8*b* and 8*c* are front views of transparency cards that have a visual image thereon and a slidable panel that can be used similar to the slidable panels shown in FIG. 8*a* to support the transparency panels when placed in the display rack of FIG. 5.
Figure 8C:
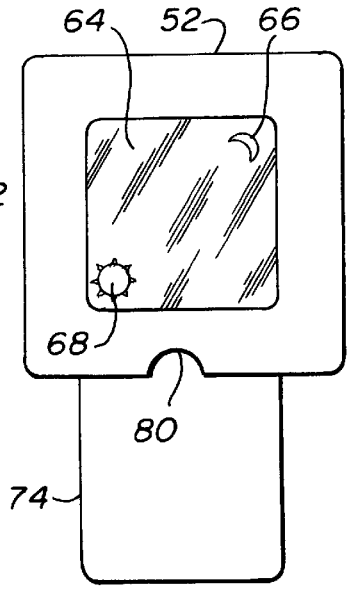

The transparency panels 50 and 52 shown in FIG. 8*b* and FIG. 8*c* are constructed similar to the reflective surface panel 48 in FIG. 8*a*. Again they have a front surface and a back surface with a window therein across which a transparency, 58 and 64 respectively, is placed in a well known manner. As shown in FIG. 8*b*, it may have visual images 60 and 62 thereon or, as shown in the embodiment of the transparency panel in FIG. 8*c*, visual images 66 and 68 thereon. Again, the panels 72 and 74 may be extended as shown or may be used to either cover the transparency panels 58 and 64 or to provide backings for transparency panels 58 and 64. Both of these type of cards are discussed and shown clearly in corresponding U.S. patent application Ser. No. 09/041,265 filed of even date herewith and entitled Transparency Display Apparatus and which is incorporated herein by reference in its entirety.

Figure 6:
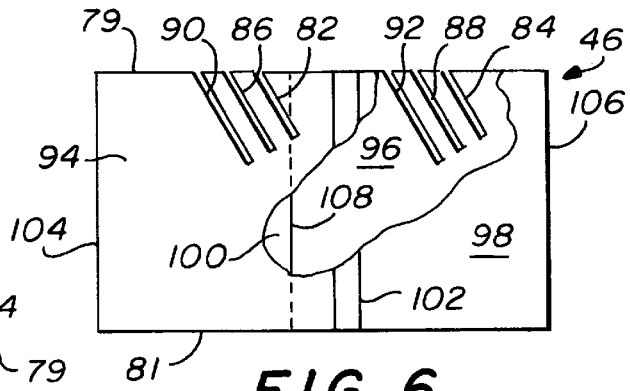
FIG. 6 is a plan view of the display rack of FIG. 5 in its folded condition with a portion thereof cut away to view the slots on both sides of the carton.

As can be seen in FIG. 5, transparency panels 50 and 52 are held in spaced apart relationship with the reflective surface 54 on panel 48 by opposing pairs of slots 82–84, 86–88, and 90–92 as shown in FIG. 6. The panels 70, 72 and 74 are extended as shown in FIGS. 8*a*, 8*b* and 8*c* so as to provide support for the display shown in FIG. 5. This can be seen more clearly in the side view illustrated in FIG. 7. Thus with the display rack as shown in FIG. 5, a unique view is created that includes the first visual image 56 on the reflective surface 54, the second and third visual images 60 and 62 and 66 and 68, respectively, on the transparency panels 50 and 52 as well as their reflected images from the mirrored surface 54.

Because the display rack 46 is a hollow rectangular box-like structure, it has four sides 94, 96, 98 and 100, a top and bottom 79 and 81, respectively, that are pivotally joined to each other at corners 102, 104, 106, and 108. As shown in FIG. 6, the display rack 46 can be flattened for shipment thus creating a minimum of space for shipping purposes.

Therefore, the rack 46 can be either in a flat collapsed state as shown in FIG. 6 or in an erected box state as shown in FIG. 5.

It will be noticed in FIGS. 5 and 6 that the plurality of slots 82–92 are tilted away from the viewer at the top 79 of the display rack 46 to enable easier viewing by the user.

Again, the slidable panels 70, 72, and 74 shown in FIGS. 8*a*, 8*b* and 8*c* are interposed between the front and back frames for movement between a first position in which the panel serves as a backing for the transparency (or a covering) and a second extended position as shown in FIGS. 8*a*, 8*b* and 8*c*. The extended position of the slidable panels provide support for holding the transparency panels in the slots in the display rack 46 in spaced apart superimposed relationship for viewing as shown in FIG. 5.

A third embodiment is illustrated in FIGS. 9, 10, 11 and 12. In this embodiment, the display device 110 comprises a first hollow rectangular container 112 having side walls and a top 114 and a bottom 116. On the inside of the bottom surface 116, there is a reflective or mirrored surface 124 on which is a first visual image 122. See FIG. 12. It will be seen in both FIG. 9 and FIG. 12 that the reflective surface 124 on the inside of the bottom 116 of the container 112 is in spaced relationship to a lid 118. The lid 118 is associated with the top 114 of the container 112 and has a window 120 therein that is covered with a transparency panel 126 having a second visual image 128 and 130 thereon to create a unique view. A ledge 132 (see FIG. 9) extends inwardly from the top 114 of the first hollow rectangular container 112 side walls. A second transparency panel 134 having a transparency 140 therein and having a third visual image 136, 138 thereon is removably placed on the ledge 132. When the lid 118 covers the top 114 of the container 112, a unique view is created that includes the first visual image 122 and the second and third visual images 128, 130 and 136, 138 and their reflections.

Figure 10:
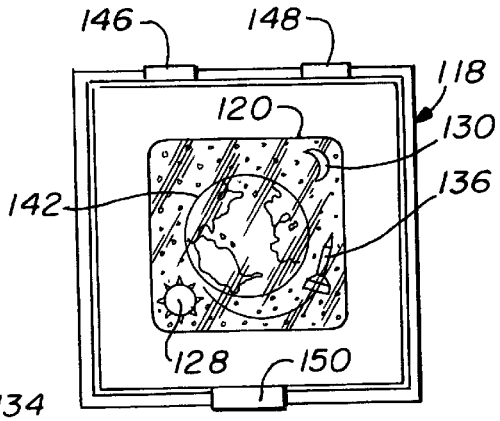
FIG. 10 is a top view of the device of FIG. 9 representing the view when the visual image on the transparency panel is reflected from the reflective surface.
Figure 11:
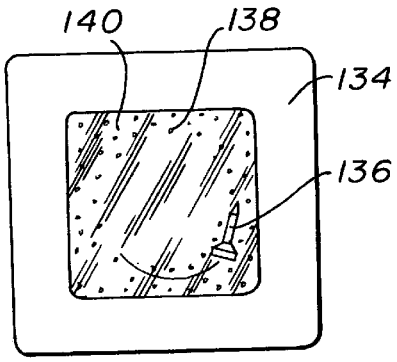
FIG. 11 is a plan view of a transparency card or panel that may be used in the container of FIG. 9 between the lid and the reflective surface.

A top view of the transparency card 134 is illustrated in FIG. 11. Thus, when the lid 118 covers the container 112, as shown in FIG. 10, a top view, a unique view is created that includes the first visual image 122 and the second and third visual images 128, 130 and 136, 138 and their reflections. Any type of catch 150, well known in the art, may be used to secure the lid 118 to the container 112 in any manner such as by hinges 146 and 148.

Figure 9:
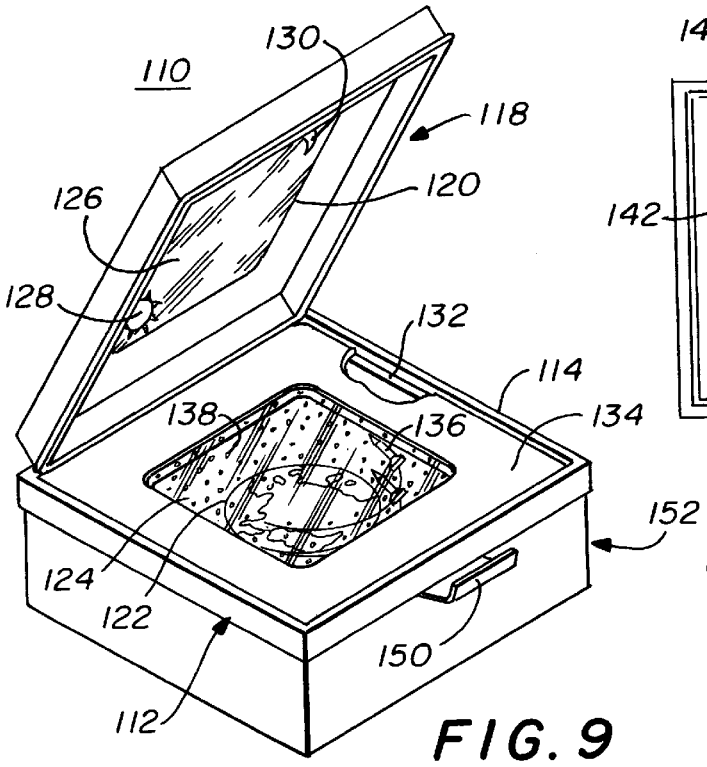
FIG. 9 is a perspective view of a third embodiment of the present invention that has a first hollow rectangular container having side walls and a top and a bottom, a lid associated with the top of the container and having a window transparency display therein, a reflective surface in the bottom of the container in spaced relationship to the lid and the transparency, with a first visual image, causing the lid window to create a unique view, when the lid is closed, by being reflected from the reflective surface at the bottom of the container.

Thus the shadow box 110 shown in FIG. 9 includes a lid 118 which has a transparency 126 therein with visual images 128 and 130 thereon. The card 134 has a transparency 138 thereon with visual images 136 and 40 that are in spaced relationship to the transparency 126 in the lid 118. At the bottom of the container 112 is a reflective surface 124 having a visual image 122 thereon in spaced relationship with both the card 134 and the lid 118. Thus an interesting and unique view is presented to the viewer when the card 134 is placed on the ledge 132 and the lid closed.

Figure 12:
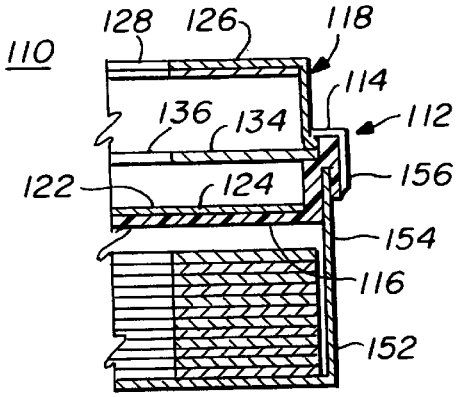
FIG. 12 is a partial cutaway section of the shadow box type transparency display of FIG. 9 illustrating the second hollow rectangular container having side walls and an open top and a closed bottom for holding a plurality of removable transparency cards or panels with visual images thereon such as shown in FIG. 11 and illustrating the coupling means for removably attaching the second container to the first container to form a unitary display device.

In order that a number of transparency cards 134 with different scenes could be used to create a unique view other than using only card 134, a base 152 forms a second hollow rectangular container having side walls and an open top and a closed bottom for holding a plurality of the removable second transparency panels 134 having different visual images thereon. Any well known coupling means such as a press fit between upper portion 154 of the walls 152 of the bottom or second hollow rectangular container 152 and an inverted U-shape recess formed in the outer walls 156 of the first, or top, hollow rectangular container 112 can be used as shown in FIG. 12. Thus, whenever desired, the user can detach the bottom container 152 from the top container 112, take out one of the transparency cards that is desired, and insert it on the ledge 132 at the upper container 112, close the lid and have another unique scene presented for viewing.

Figure 13:
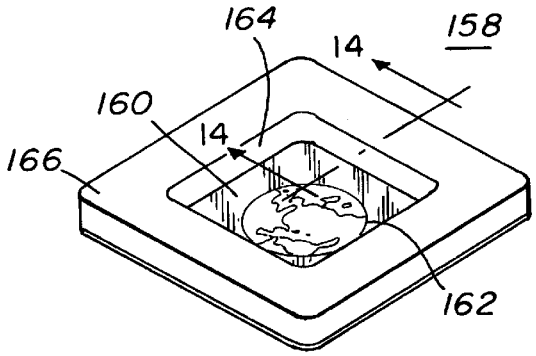
FIG. 13 is a perspective view of a shadow box having a mirrored or reflective surface on the bottom thereof with indicia placed on the reflective surface to create a first image and with which the transparency cards of FIGS. 8*b* and 8*c* or of FIG. 11 can be used in spaced relationship with the reflective surface to create a unique visual image.
Figure 14:
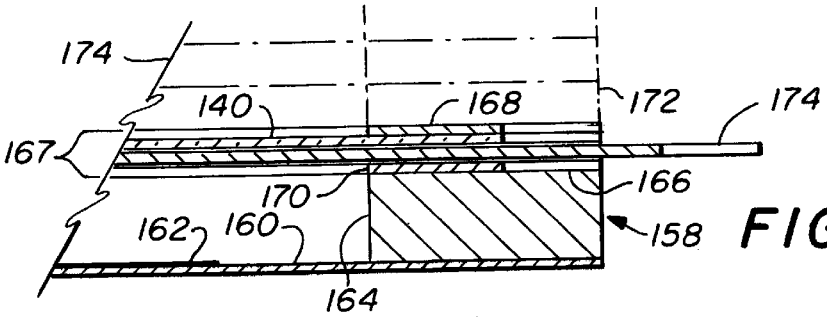
FIG. 14 is a partial cutaway view of the shadow box type transparency display device shown in FIG. 13.

The final version of the shadow box type transparency display device is illustrated in FIGS. 13 and 14. In FIG. 13 it can be seen that the transparency display device 158 includes a reflective surface 160 having a visual image 162 thereon at the bottom of a recess 164 spaced from the top 166. By placing a card such as the card shown in FIG. 11 over the top 166 of the transparency display device 158, the visual images 136 and 138 on the transparency card 134 are spaced from and in superimposed relationship with at least a portion of the reflective surface 160 such that the visual image 136, 138 on card 134 would be visible in the reflective surface 160 thereby creating a unique view that includes the visual image 162 on the reflective surface, the visual images 136 and 138 of transparency card 134 and the reflected views of the visual images 136, 138. A cross-section of the device in FIG. 13 is shown in FIG. 14. It shows the device 158 having a base reflective surface 160 with a visual image 162 thereon spaced at a depth along wall 164 from the top 166. Placed on the top 166 may be a transparency panel 167 (FIG. 14) that includes a front frame 168 and a bottom frame 170 with a transparency 140 thereon having indicia 136 and 138 as shown in FIG. 11. If desired, a slidable panel 74 such as that shown in FIG. 8*b* may be used to cover and uncover the visual image on the transparency 168. Additional transparency cards 172 and 174, as represented by phantom lines, may be stacked on top of the display device 158 to provide additional unique viewing scenes.

Thus there has been disclosed a number of unique embodiments of a shadow box type transparency display device that allows a user to uniquely view a plurality of visual images in spaced apart relationship with a reflective surface that may or may not have a visual image thereon to create unique scenes as the user views them. One version is simply a shadow box with a reflective surface having no visual image thereon and on which can be placed transparency cards having visual images thereon to create the unique scenes. A second embodiment includes a shadow box having a visual image on a reflective surface spaced apart from transparency display cards having images thereon that can be stacked one on top of the other to create unique visual scenes.

A third embodiment includes a display rack having a plurality of opposing slots in opposing side walls in which display cards are mounted in superimposed front to back relationship with each other, each display card having a transparency thereon with a visual scene imprinted on the transparency and the last card having a reflective surface that may or may not have a visual image thereon. These cards are all placed in the slots in spaced apart relationship with respect to each other so as to create a unique shadow box type visual image. The final embodiment includes a first container having a lid and a bottom reflective surface spaced from the lid. The bottom reflective surface may have a first visual image thereon. The lid also has a transparency display therein with a second visual image thereon and inside the container, on a supporting ledge, a transparency card may be placed having a third visual image thereon such that when the lid is closed, a novel scene is presented with three spaced apart visual images and the reflection of the last two of them in the reflective surface. In addition, this device may have a second container removably attached to the base of it that can contain a plurality of transparency displays that can be viewed with the scene on the lid and the reflective surface visual image in various combinations.

While the various scenes have been shown in relation to space such as the earth, moon, sun, stars and rocket ship, it is to be understood that the scenes could be used with prominent personalities such as athletes, movie stars, and the like. In addition, places could be depicted such as the Grand Canyon, Mt. Rushmore and the like. Such display devices could also be formed as greeting cards with any of the embodiments.

It will be understood that one skilled in the art, after reviewing this disclosure, can conceive of various embodiments not disclosed herein that are a part of the present invention and that are covered by the claims herein.

The corresponding structures, materials, acts, and equivalents of all means or step plus function elements in the claims below are intended to include any structure, material, or act for performing the function in combination with other claimed elements as specifically claimed.

I claim:

1. A shadow box type transparency display device comprising:

a reflective surface;

at least two transparency panels having first and second visual images respectively thereon spaced from each other and from and in superimposed relationship with at least a portion of the reflective surface such that a reflection of said first and second visual images are visible in said reflective surface thereby creating a unique view that includes the first and second visual images and said reflection of said first and second visual images;

a slidable opaque panel attached to said shadow box device;

said slidable panel having a first position covering said transparency panels and serving as a dust cover; and said slidable panel having a second position exposing said transparency panels to enable viewing of said first and second visual images and their reflection from said reflective surface.

2. The transparency display device of claim 1 wherein said transparency display device is a greeting card.

3. The transparency display device of claim 1 further comprising a third visual image on at least a portion of said reflective surface thereby creating said unique view with said first, second and third visual images and said reflected first and second visual images.

4. The transparency display device of claim 3 wherein said third visual image is formed on said reflective surface by a printing process.

5. The transparency display device of claim 3 wherein said third visual image is formed on said reflective surface.

6. A shadow box type transparency display device comprising:

a reflective surface;

at least one transparency panel having a first visual image thereon spaced from and in superimposed relationship with at least a portion of the reflective surface such that a reflection of said first visual image is visible in said reflective surface thereby creating a unique view that includes the first visual image and said reflection of said first visual image; and an opaque panel slidably interposed between said transparency panel and a closed bottom portion of the shadow box for movement between a first position to enable viewing of only said transparency panel and said first visual image thereon with the slidable panel serving as a backing for said transparency panel and a second position to enable viewing of said first visual image and its reflection from said reflective surface.

7. The transparency display device of claim 6 wherein said transparency display device is a greeting card.

8. The transparency display device of claim 6 further comprising a second visual image on at least a portion of said reflective surface thereby creating said unique view with said first and second visual images and said reflected first visual image.

9. The transparency display device of claim 8 wherein said second visual image is formed on said reflective surface by a printing process.

10. The transparency display device of claim 8 wherein said second visual image is formed on said reflective surface by a photographic process.

11. The transparency display device of claim 6 further comprising:

a second visual image on said slidable panel such that said first and second images are visible in said first position; and said first visual image and its reflection from said reflective surface are visible in said second position.

12. The transparency display device of claim 6 wherein said at least one transparency panel comprises at least two transparency panels.

* * * * *